US012078052B2

(12) United States Patent
Cabella et al.

(10) Patent No.: US 12,078,052 B2
(45) Date of Patent: Sep. 3, 2024

(54) TUBING ECCENTRICITY EVALUATION USING ACOUSTIC SIGNALS

(71) Applicant: Halliburton Energy Services, Inc., Houston, TX (US)

(72) Inventors: Brenno Caetano Troca Cabella, Rio de Janeiro (BR); Xiang Wu, Singapore (SG); Marco Aurelio Luzio, Rio de Janeiro (BR); Pablo Vieira Rego, Rio de Janeiro (BR); Chung Chang, Houston, TX (US); Federico Combis Lucas, Houston, TX (US); Yao Ge, Singapore (SG); Ruijia Wang, Singapore (SG); Ho Yin Ma, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 220 days.

(21) Appl. No.: 17/543,130

(22) Filed: Dec. 6, 2021

(65) Prior Publication Data

US 2023/0175391 A1 Jun. 8, 2023

(51) Int. Cl.

| | |
|---|---|
| ***E21B 47/085*** | (2012.01) |
| ***E21B 47/095*** | (2012.01) |
| ***E21B 47/16*** | (2006.01) |

(52) U.S. Cl.

CPC ..... *E21B 47/085* (2020.05); *E21B 47/095* (2020.05); *E21B 47/16* (2013.01); *E21B 2200/22* (2020.05)

(58) Field of Classification Search

CPC ..... E21B 47/085; E21B 47/095; E21B 47/16

See application file for complete search history.

(56) References Cited

U.S. PATENT DOCUMENTS

| | | | |
|---|---|---|---|
| 3,095,083 | A | 6/1963 | Helble et al. |
| 4,027,527 | A | 6/1977 | Bennett et al. |

(Continued)

FOREIGN PATENT DOCUMENTS

| | | | |
|---|---|---|---|
| BR | 112018013963 | A2 | 12/2018 |
| BR | 112020002446 | A2 | 7/2020 |

(Continued)

OTHER PUBLICATIONS

Zeroug, et al.; "Sonic and Ultrasonic Measurement Applications for Cased Oil Wells"; 19th World Conference on Non-Destructive Testing; 2016; 12 pgs.

*Primary Examiner* — Kristyn A Hall

(74) *Attorney, Agent, or Firm* — John Wustenberg; Parker Justiss, P. C.

(57) ABSTRACT

The disclosure presents processes to determine the direction and magnitude of tubing eccentricity along the length of a tube inserted within a borehole. The tubing can be a wire-line, a drill string, a drill pipe, or tubing capable of allowing fluid or other material to flow through it. As borehole operations proceed, the tubing can move toward the side of the borehole. This eccentricity can cause excess wear and tear on the tubing, on the casing of the borehole, or on the inner surface of the subterranean formation. The eccentricity can be measured using acoustic signals that are collected downhole covering the azimuthal angles 0° to 360° at a location in the borehole. The collected signals can be filtered, transformed, and analyzed to estimate the tubing eccentricity. Other processes and systems can use the results to obtain cement bond evaluations through tubing and to determine preventative or restorative actions.

23 Claims, 10 Drawing Sheets

(56) References Cited

U.S. PATENT DOCUMENTS

| | | | | |
|---|---|---|---|---|
| 5,168,470 | A | 12/1992 | Dennis et al. | |
| 7,778,778 | B2 | 8/2010 | Bespalov et al. | |
| 10,705,056 | B2 | 7/2020 | Lei et al. | |
| 2008/0170466 | A1 | 7/2008 | Mickael | |
| 2011/0182141 | A1 | 7/2011 | Zhamikov et al. | |
| 2012/0217067 | A1* | 8/2012 | Mebane, III ..... | E21B 44/02 175/57 |
| 2020/0116884 | A1 | 4/2020 | Weng et al. | |
| 2020/0190974 | A1 | 6/2020 | Manders | |
| 2020/0400015 | A1 | 12/2020 | Ge et al. | |
| 2021/0054728 | A1 | 2/2021 | Fellinghaug et al. | |
| 2021/0215034 | A1 | 7/2021 | Steel et al. | |

FOREIGN PATENT DOCUMENTS

| | | | |
|---|---|---|---|
| CA | 2615109 | A1 | 7/2008 |
| CA | 3063567 | A1 | 6/2020 |
| CN | 110185395 | A | 8/2019 |
| DE | 202009004358 | U1 | 8/2009 |
| FR | 1340086 | A | 10/1963 |
| GB | 955060 | | 4/1964 |
| JP | H05144051 | A | 6/1993 |
| JP | 2004360443 | A | 12/2004 |
| KR | 20200053738 | A | 5/2020 |
| NO | 342295 | B1 | 4/2018 |
| WO | 2020096183 | A1 | 5/2020 |

* cited by examiner

TUBING ECCENTRICITY EVALUATION USING ACOUSTIC SIGNALS

TECHNICAL FIELD

This application is directed, in general, to analyzing tubing eccentricity and, more specifically, to using acoustic signals to measure tubing eccentricity.

BACKGROUND

In developing a borehole, for scientific, hydrocarbon production, or other purposes, tubing or piping inserted into the borehole can experience eccentricity with respect to the borehole or casing lining the borehole. Tubing experiencing eccentricity, can cause wear on the casing or the surface of subterranean formations within the borehole. It can also cause wear on the tubing itself. Tubing eccentricity can cause other borehole operational inefficiencies as well. The wear or operational inefficiencies may need to be addressed through updating operational plans or mitigation actions. Knowing the direction and magnitude of tubing eccentricity within a borehole would be beneficial in identifying these areas of potential operational inefficiencies or potential areas needing mitigation actions.

SUMMARY

In one aspect, a method to determine eccentricity of a tubing is disclosed. In one embodiment, the method includes (1) collecting acoustic data from an acoustic system located downhole a borehole, wherein the acoustic data is collected at more than one azimuthal position at a borehole location, the acoustic system includes an acoustic transmitter located at an offset from an acoustic receiver, and the tubing is located within the borehole, (2) applying a fast Fourier transformation (FFT) filter to the acoustic data to generate transformed acoustic data using an acoustic analyzer, (3) calculating a central value of the transformed acoustic data, (4) identifying a tubing arrival time using the central value and the transformed acoustic data, wherein the tubing arrival time relates to the acoustic data and the tubing, (5) determining a symmetry of axis for the transformed acoustic data, (6) calculating an eccentricity direction of the tubing using the symmetry of axis, and the transformed acoustic data, (7) identifying an earliest casing arrival time utilizing the transformed acoustic data, and (8) computing an eccentricity magnitude of the tubing utilizing the transformed acoustic data, received input parameters, the tubing arrival time, and the earliest casing arrival time, using the acoustic analyzer.

In a second aspect, a system is disclosed. In one embodiment, the system includes (1) a data transceiver, capable of receiving input parameters and collected acoustic data, wherein the acoustic data is collected downhole a borehole at one or more locations along the borehole, and where a tubing is located within the borehole, and (2) an acoustic analyzer, capable of communicating with the data transceiver, applying one or more transformation algorithms to the acoustic data, applying one or more filtering algorithms to the acoustic data, calculating a central value of the acoustic data, identifying a tubing arrival time, determining a symmetry of axis of the acoustic data, calculating an eccentricity direction of the tubing, identifying an earliest casing arrival time, and computing an eccentricity magnitude of the tubing.

In a third aspect, a computer program product having a series of operating instructions stored on a non-transitory computer-readable medium that directs a data processing apparatus when executed thereby to perform operations to determine eccentricity of a tubing is disclosed. In one embodiment, the computer program product operations include (1) collecting acoustic data from an acoustic system located downhole a borehole, wherein the acoustic data is collected at more than one azimuthal position at a borehole location, the acoustic system includes an acoustic transmitter located at an offset from an acoustic receiver, and the tubing is located within the borehole, (2) applying a FFT filter to the acoustic data to generate transformed acoustic data using an acoustic analyzer, (3) calculating a central value of the transformed acoustic data, (4) identifying a tubing arrival time using the central value and the transformed acoustic data, wherein the tubing arrival time relates to the acoustic data and the tubing, (5) determining a symmetry of axis for the transformed acoustic data, (6) calculating an eccentricity direction of the tubing using the symmetry of axis, and the transformed acoustic data, (7) identifying an earliest casing arrival time utilizing the transformed acoustic data, and (8) computing an eccentricity magnitude of the tubing utilizing the transformed acoustic data, received input parameters, the tubing arrival time, and the earliest casing arrival time, using the acoustic analyzer.

BRIEF DESCRIPTION

Reference is now made to the following descriptions taken in conjunction with the accompanying drawings, in which.

DETAILED DESCRIPTION

Figure 1:
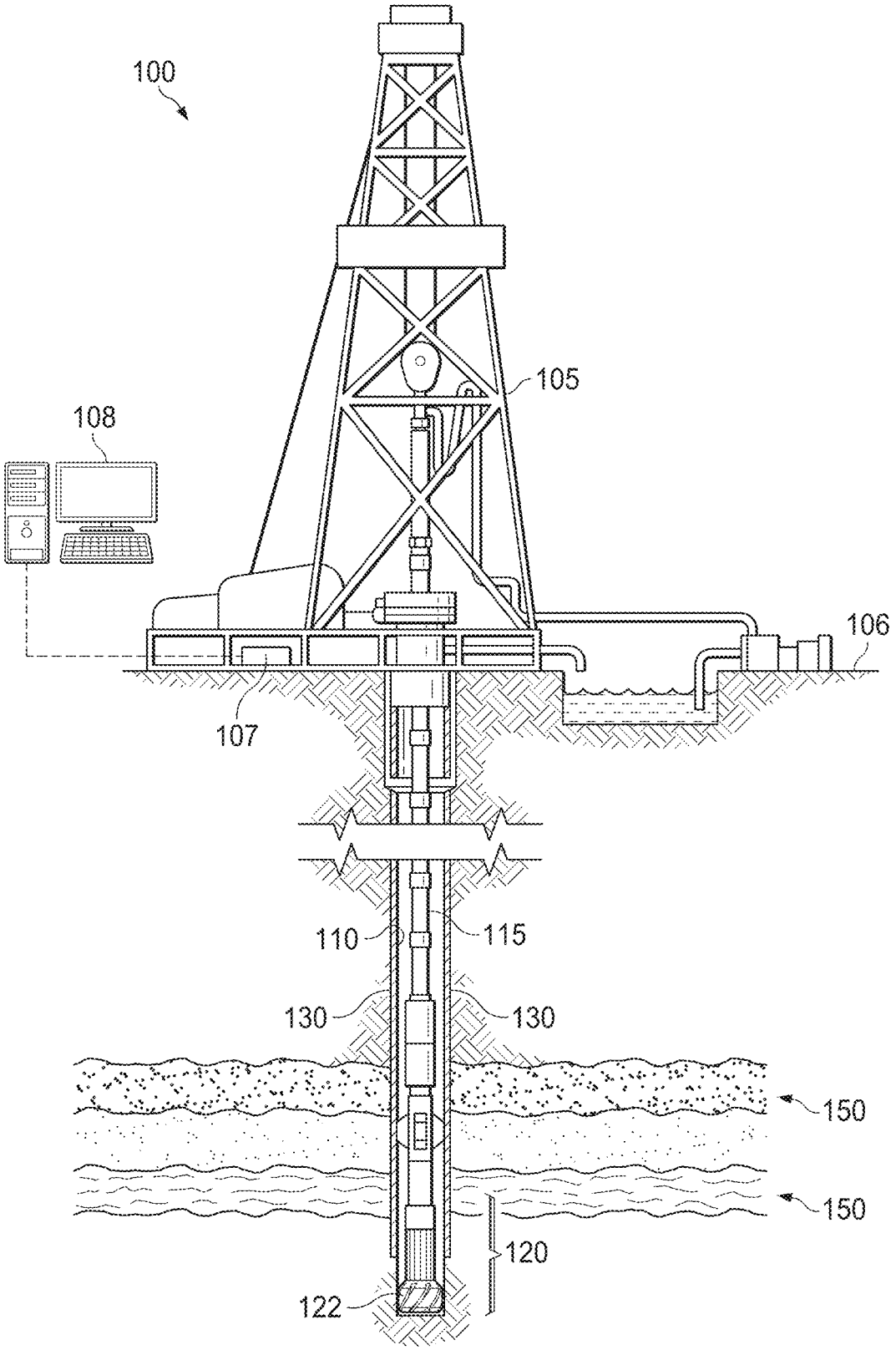
FIG. 1 is an illustration of a diagram of an example drilling system.

In developing boreholes, a tube, e.g., pipe, can be inserted into the borehole where the tube can provide support for or an access path for tools, wirelines, or the movement of material, such as muds, brines, fluids, liquids, hydrocarbons, gasses, and other substances. Boreholes can be for hydrocarbon production, scientific purposes, or for other uses. Boreholes can be exposed subterranean formations, e.g., rock, boreholes can be lined with one or more types of casings, or boreholes can have a combination of casings and exposed subterranean formations. For example, as drilling operations progress, the upper portion of the borehole can be cased and the newly drilled portion of the borehole can be rock.

The tubing can be drilling pipe, e.g., drill string, supporting a drilling tool at its lower end, where the upper end is at a surface rig. The tubing can be a conduit for a wireline, such as a wireline supporting wireline tools, for example sensors. The tubing can be a conduit for muds being pumped downhole or uphole, as well as for pumping water, brine, saline, or other substances downhole or uphole. The tubing can be a conduit for extracting hydrocarbons or other materials from a downhole location.

During operations, the tubing can be rotated, for example, rotating a drilling pipe to power a drilling operation. In some operations, the tubing may not be rotating. As the operations within the borehole are conducted, the tubing can shift its azimuthal position relative to the center point of the borehole. As a result, a rotating or non-rotating tube could potentially impact a portion of the casing or borehole inner surface. The tube could potentially cause wear as the tube touches a portion of the casing or borehole inner surface. The impact or wear can cause wear to the casing, damage to the borehole inner surface, or wear to the tubing. Tubing eccentricity can make it difficult to evaluate cement bond conditions behind the casing. Therefore, knowing tubing eccentricity direction and magnitude can be useful to make the proper adjustments in cement bond evaluation algorithms in through tubing scenarios.

Understanding how the tubing shifts within the borehole can be important to borehole operations, for example, to alert operators to locations within the borehole or positions along the tubing that are subject to wear so corrective action can be undertaken. For example, a corrective action can be to monitor a casing portion and replace the casing portion if the wear exceeds operational thresholds, or to adjust the position of the tube within the borehole.

The ability to monitor the azimuthal position of the tube within the borehole at specific axial locations is an important operation. Typically, a through tubing cement evaluation (TTCE) technique is used. TTCE can use acoustic waves to gather data about the tubing position relative to the casing and borehole. TTCE can be a challenge dealing with multiple wave modes and interactions, such as reflections, dispersion, refraction through different media, and wave superposition, which can render TTCE unfeasible, or extremely difficult, to characterize.

Some features of the material behind the casing can be more easily obtained if the tubing is concentric with the casing. In typical situations the tubing can be eccentric with the casing and therefore a better method to evaluate the direction and magnitude of the eccentricity would be beneficial.

Using TTCE, this disclosure presents an automated process to extract the direction and the magnitude of the tubing eccentricity relative to the casing or borehole inner surface. The disclosure specifies obtaining a 360° of acoustic information using a rotating unipole transmitter azimuthally aligned with the receiver where there can be an axial offset between the two transducers. The number of azimuths at which data is collected can vary, such as every 5° resulting in 72 data collection positions. Other degree arcs can be utilized, such as using 2° intervals, 6° intervals, 10° intervals, or interval degree arc intervals for the acoustic data collection.

The rotational signal data that is collected can be processed with input parameters. The input parameters can include information about the tubular system geometries, e.g., tubing diameters and tubing thickness, casing diameters and casing thickness, and characteristics of the subterranean formation at the location of the data collection.

The processes described can be implemented using conventional hardware implementations. The processes described do not need to rely on external sources of information used for comparison and classification, such as a database of known standards and libraries containing information about different eccentricity configurations. The processes can extract the acoustic wave arrival time information, reflected from the tubing and reflected from the casing or inner surface of the borehole, from the collected waveforms without the need for additional post-logging information.

This approach can utilize the reflected signal from the tubing to the advantage of the algorithm as opposed to eliminating the reflected data as is done conventionally. This process can simplify the process of quantifying the eccentricity level, which in turn can avoid undesirable filtering of relevant information. The described processes can minimize hardware resources by focusing on computational power, can be reliable and repeatable due to that the arrival times of the waveforms are utilized in the algorithm, and can rely on the information obtained during the TTCE process and not necessarily need additional information. The direction and magnitude of the tubing eccentricity can be determined to calculate the eccentricity changes along the borehole depth.

In some aspects, the output of the process is a direction of displacement in the azimuthal plane at a specified location along the borehole, and a magnitude of the displacement. In some aspects, the output can be an eccentricity parameter. The eccentricity parameter can be calculated, for example, using Equation 1.

Example eccentricity calculation — Equation 1

$$ecc(\%) = \left(1 - \frac{2d}{C_{ID} - T_{OD}}\right) \times 100\%$$

where $C_{ID}$ is the casing inner diameter, or the diameter of the borehole, $T_{OD}$ is the tubing outer diameter, and d is minimal distance between the tubing and the casing or borehole inner surface.

Turning now to the figures, FIG. 1 is an illustration of a diagram of an example drilling system 100, for example, a logging while drilling (LWD) system, a measuring while drilling (MWD) system, a seismic while drilling (SWD)

system, a telemetry while drilling (TWD) system, injection well system, extraction well system, and other borehole systems. Drilling system 100 includes a derrick 105, a well site controller 107, and a computing system 108. Well site controller 107 includes a processor and a memory and is configured to direct operation of drilling system 100. Derrick 105 is located at a surface 106.

Extending below derrick 105 is a borehole 110 with downhole tools 120 at the end of a drill string 115. Downhole tools 120 can include various downhole tools, such as a formation tester or a bottom hole assembly (BHA). Downhole tools 120 can include an acoustic sensor system, such as a transmitter, receiver, and an acoustic analyzer capable of collecting and analyzing the collected data. At the bottom of downhole tools 120 is a drilling bit 122. Other components of downhole tools 120 can be present, such as a local power supply (e.g., generators, batteries, or capacitors), telemetry systems, sensors, transceivers, and control systems. Borehole 110 is surrounded by subterranean formation 150.

Well site controller 107 or computing system 108 which can be communicatively coupled to well site controller 107, can be utilized to communicate with downhole tools 120, such as sending and receiving acoustic data, telemetry, data, instructions, subterranean formation measurements, and other information. Computing system 108 can be proximate well site controller 107 or be a distance away, such as in a cloud environment, a data center, a lab, or a corporate office. Computing system 108 can be a laptop, smartphone, PDA, server, desktop computer, cloud computing system, other computing systems, or a combination thereof, that are operable to perform the processes described herein. Well site operators, engineers, and other personnel can send and receive data, instructions, measurements, and other information by various conventional means, now known or later developed, with computing system 108 or well site controller 107. Well site controller 107 or computing system 108 can communicate with downhole tools 120 using conventional means, now known or later developed, to direct operations of downhole tools 120.

Casing 130 can act as barrier between subterranean formation 150 and the fluids and material internal to borehole 110, as well as drill string 115. As drill string 115 rotates within borehole 110 or during trip in or trip out operations, there can be wear of casing 130 at certain locations due to the eccentricity of drill string 115 within borehole 110. An acoustic analyzer system can be used to collect data on the eccentricity of drill string 115. In some aspects, the acoustic analyzer system can perform the filtering and analyzation of the acoustic data. In some aspects, the acoustic analyzer can communicate the collected data or the results to another system, such as computer system 108 or well site controller 107 where the acoustic data can be filtered and analyzed. The results of the acoustic analyzer can be used to determine the eccentricity of drill string 115 in relation to borehole 110. In some aspects, computing system 108 can be the acoustic analyzer. In some aspects, well site controller 107 can be the acoustic analyzer. In some aspects, the acoustic analyzer can be partially included with well site controller 107 and computing system 108.

Figure 2:
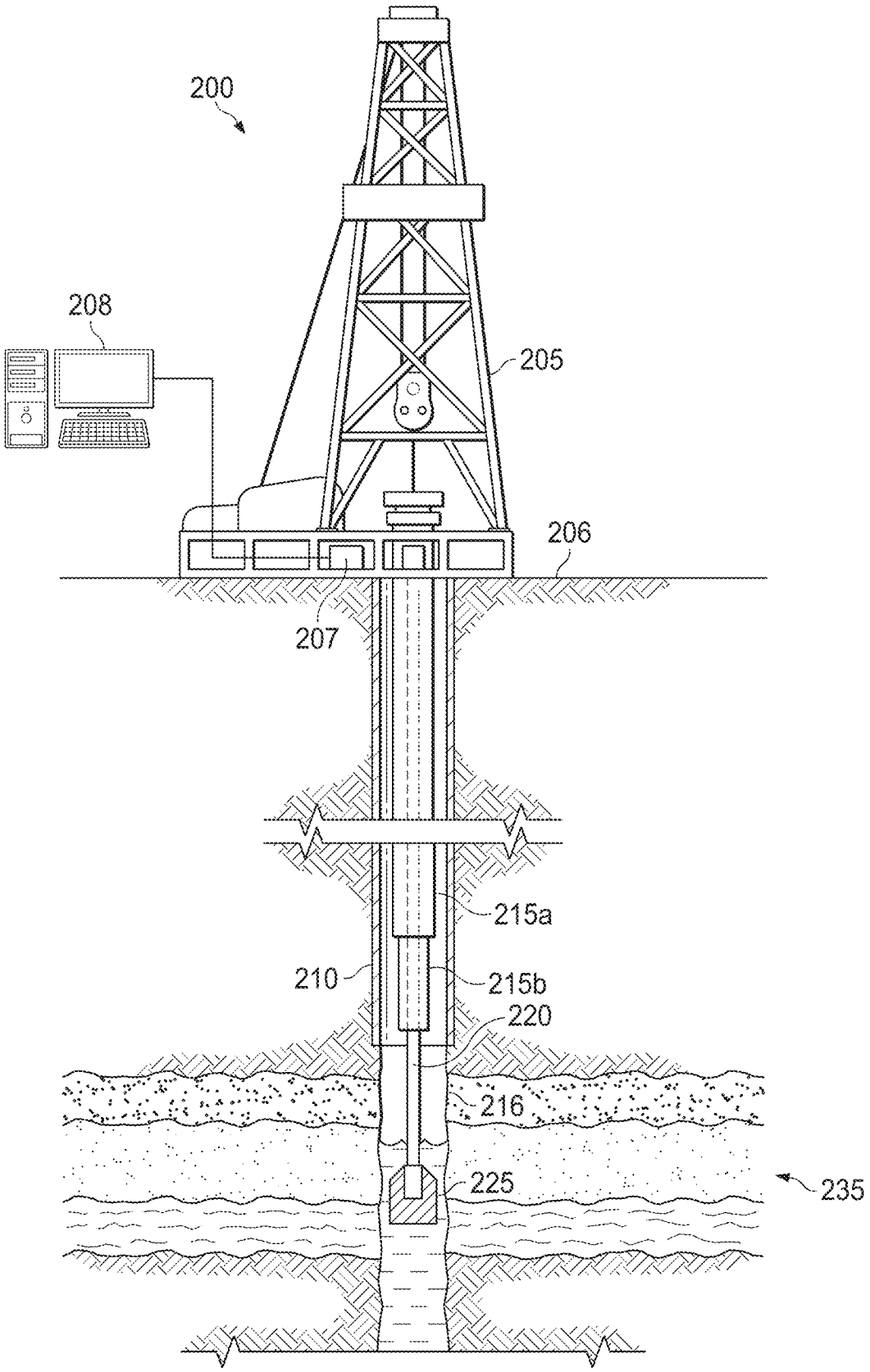
FIG. 2 is an illustration of a diagram of an example wireline system.

FIG. 2 is an illustration of a diagram of an example wireline system 200. Wireline system 200 depicts a wireline well system and includes a derrick 205, a well site controller 207, and a computing system 208. Well site controller 207 includes a processor and a memory and is operable to direct operation of wireline system 200. Derrick 205 is located at a surface 206. Computing system 208 can be proximate well site controller 207 or be a distance away, such as in a cloud environment, a data center, a lab, or a corporate office. Computing system 208 can be a laptop, smartphone, PDA, server, desktop computer, cloud computing system, and other computing systems.

Extending below derrick 205 is a borehole 210, with a cased section 215*a*, a cased section 215*b*, and one uncased section 216. Wireline 220 is inserted in borehole 210 to hold a downhole tool 225. Borehole 210 is surrounded by a subterranean formation 235 which includes a hydrocarbon reservoir. Cased section 215*a* and cased section 215*b* can be designed to withstand subterranean formation 235 as well as the operations of downhole tool 225.

Downhole tools 225 can include an acoustic system, such as a transmitter and receiver. In some aspects, downhole tools 225 can include an acoustic analyzer to analyze the collected acoustic data. The analyzed data can be communicated to one or more other systems, such as well site controller 207 or computing system 208. In some aspects, the collected acoustic data can be transmitted to another system, such as well site controller 207 or computing system 208. Well site controller 207 or computing system 208 can be an acoustic analyzer or an acoustic analyzer controller. In some aspects, the acoustic analyzer or an acoustic analyzer controller can be partially in well site controller 207, partially in computing system 208, partially in another computing system, or various combinations thereof. The results of the acoustic analyzer or acoustic analyzer controller can be used to determine the eccentricity of wireline 220 in relation to borehole 210, cased section 215*a*, or cased section 215*b*.

Figure 3:
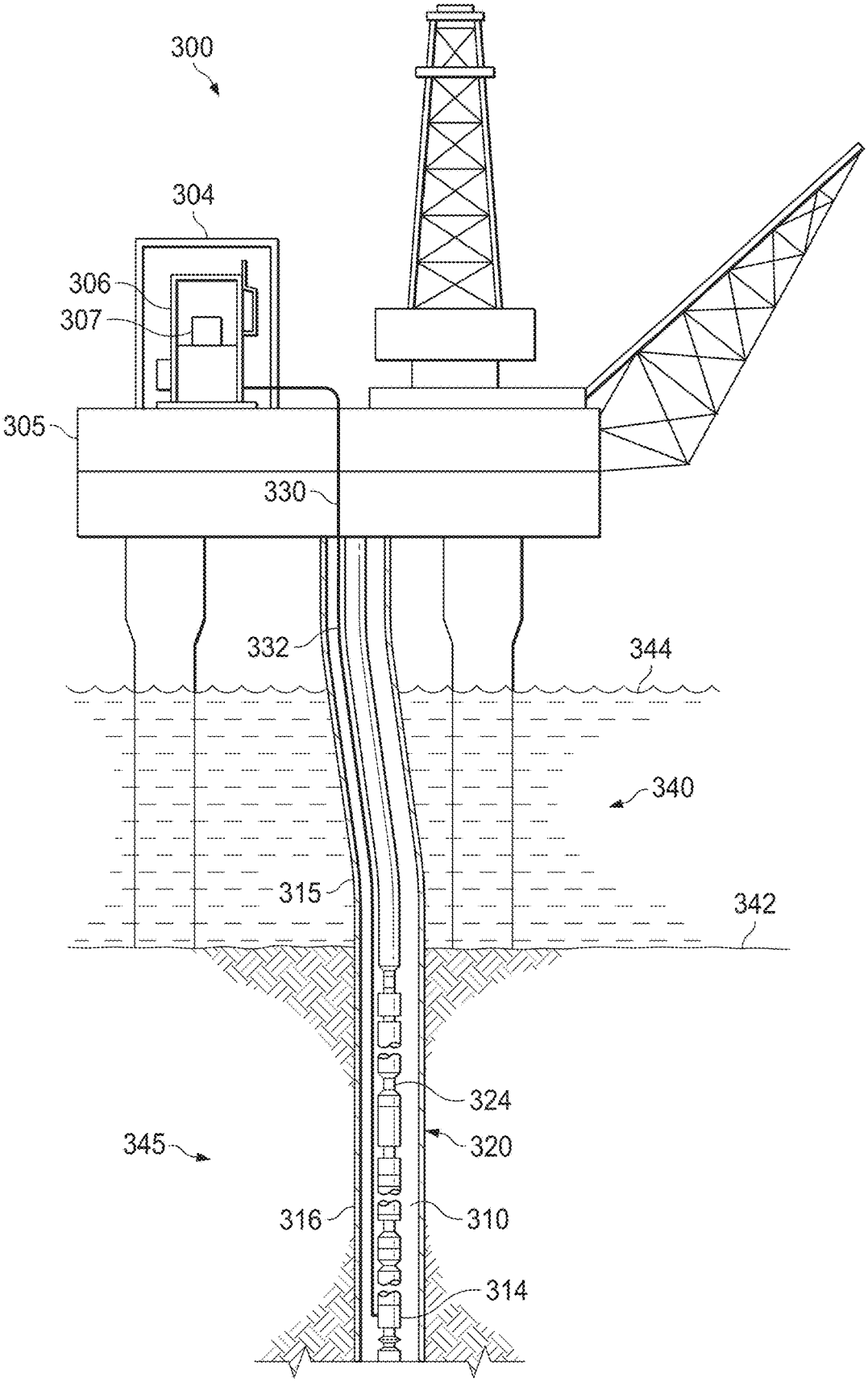
FIG. 3 is an illustration of a diagram of an example offshore system.

FIG. 3 is an illustration of a diagram of an example offshore system 300 with an electric submersible pump (ESP) assembly 320. ESP assembly 320 is placed downhole in a borehole 310 below a body of water 340, such as an ocean or sea. Borehole 310, protected by casing, screens, or other structures, is surrounded by subterranean formation 345. ESP assembly 320 can be used for onshore operations. ESP assembly 320 includes a well controller 307 (for example, to act as a speed and communications controller of ESP assembly 320), an ESP motor 314, and an ESP pump 324.

Well controller 307 is placed in a cabinet 306 inside a control room 304 on an offshore platform 305, such as an oil rig, above water surface 344. Well controller 307 is configured to adjust the operations of ESP motor 314 to improve well productivity. In the illustrated aspect, ESP motor 314 is a two-pole, three-phase squirrel cage induction motor that operates to turn ESP pump 324. ESP motor 314 is located near the bottom of ESP assembly 320, just above downhole sensors within borehole 310. A power/communication cable 330 extends from well controller 307 to ESP motor 314. A fluid pipe 332 fluidly couples equipment located on offshore platform 305 and ESP pump 324.

In some aspects, ESP pump 324 can be a horizontal surface pump, a progressive cavity pump, a subsurface compressor system, or an electric submersible progressive cavity pump. A motor seal section and intake section may extend between ESP motor 314 and ESP pump 324. A riser 315 separates ESP assembly 320 from water 340 until sub-surface 342 is encountered, and a casing 316 can separate borehole 310 from subterranean formation 345 at and below sub-surface 342. Perforations in casing 316 can allow the fluid of interest from subterranean formation 345 to enter borehole 310.

ESP assembly 320 can include an acoustic system, such as a transmitter and receiver. In some aspects, ESP assembly 320 can include an acoustic analyzer to analyze the collected acoustic data. The analyzed data, e.g., results, can be communicated to one or more other systems, such as well controller 307. In some aspects, the collected acoustic data can be transmitted to another system, such as well controller 307. Well controller 307 can be an acoustic analyzer or an acoustic analyzer controller. In some aspects, the acoustic analyzer or an acoustic analyzer controller can be partially in well controller 307, partially in another computing system, or various combinations thereof. The results of the acoustic analyzer or acoustic analyzer controller can be used to determine the eccentricity of ESP assembly 320 in relation to borehole 310, riser 315, or casing 316.

FIGS. 1 and 2 depict onshore operations. Those skilled in the art will understand that the disclosure is equally well suited for use in offshore operations, such as shown in FIG. 3. FIGS. 1-3 depict specific borehole configurations, those skilled in the art will understand that the disclosure is equally well suited for use in boreholes having other orientations including vertical boreholes, horizontal boreholes, slanted boreholes, multilateral boreholes, and other borehole types.

Figure 4A:
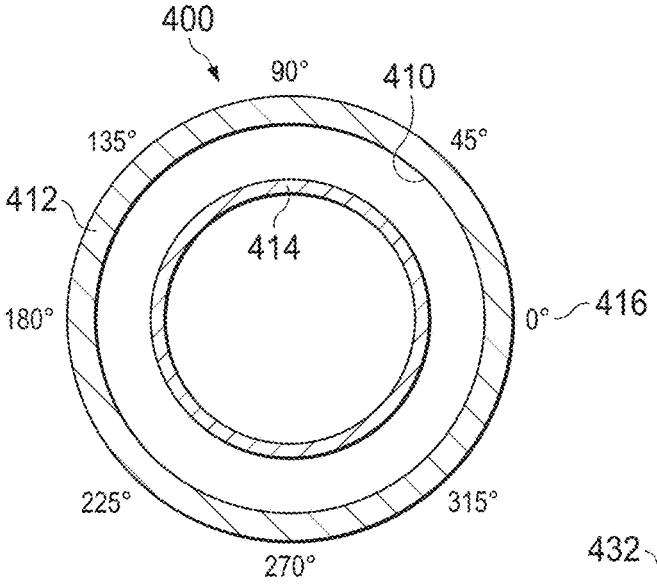
FIG. 4A is an illustration of a diagram of an example view demonstrating a neutral tubing eccentricity.

FIG. 4A is an illustration of a diagram of an example view demonstrating a neutral tubing eccentricity 400. Neutral tubing eccentricity 400 demonstrates a cross sectional view of a borehole 410 with a casing 412 (outer black circle). Inserted in borehole 410 is a tubing 414 (inner black circle). Azimuthal angles 416 are arrayed around borehole 410, where the 0° mark is determined by the system or is user determined. Tubing 414 is concentric with casing 412.

Figure 4B:
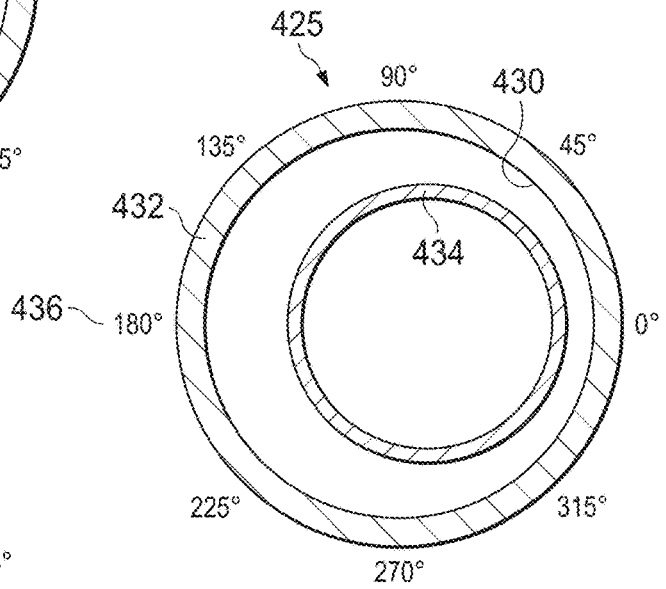
FIG. 4B is an illustration of a diagram of an example view demonstrating a 0° tubing eccentricity.

FIG. 4B is an illustration of a diagram of an example view demonstrating a 0° tubing eccentricity 425. 0° tubing eccentricity 425 demonstrates a cross sectional view of a borehole 430 with a casing 432 (outer black circle). Inserted in borehole 430 is a tubing 434 (inner black circle). Azimuthal angles 436 are arrayed around borehole 430, where the 0° mark is determined by the system or is user determined. Tubing 434 has a magnitude of tubing eccentricity of approximately 25% of the distance toward casing 432 at a direction of approximately the 0° azimuthal angle.

Figure 4C:
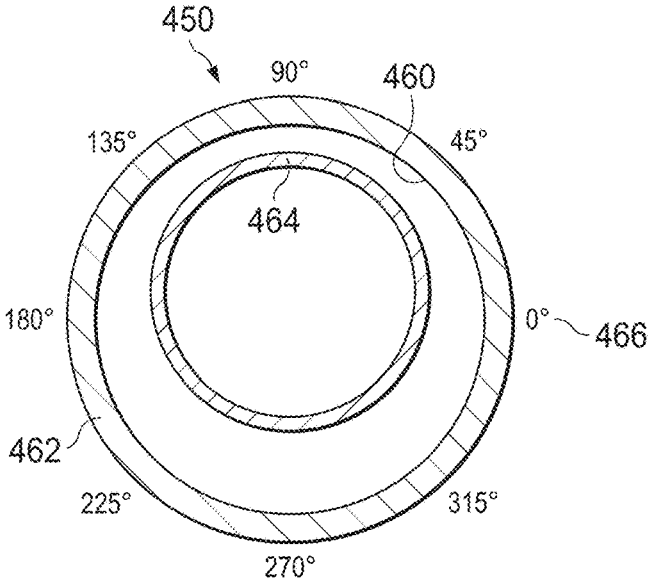
FIG. 4C is an illustration of a diagram of an example view demonstrating a 90° tubing eccentricity.

FIG. 4C is an illustration of a diagram of an example view demonstrating a 90° tubing eccentricity 450. 90° tubing eccentricity 450 demonstrates a cross sectional view of a borehole 460 with a casing 462 (outer black circle). Inserted in borehole 460 is a tubing 464 (inner black circle). Azimuthal angles 466 are arrayed around borehole 460, where the 0° mark is determined by the system or is user determined. Tubing 464 has a magnitude of tubing eccentricity of approximately 50% of the distance toward casing 462 at a direction of approximately the 90° azimuthal angle.

Figure 4D:
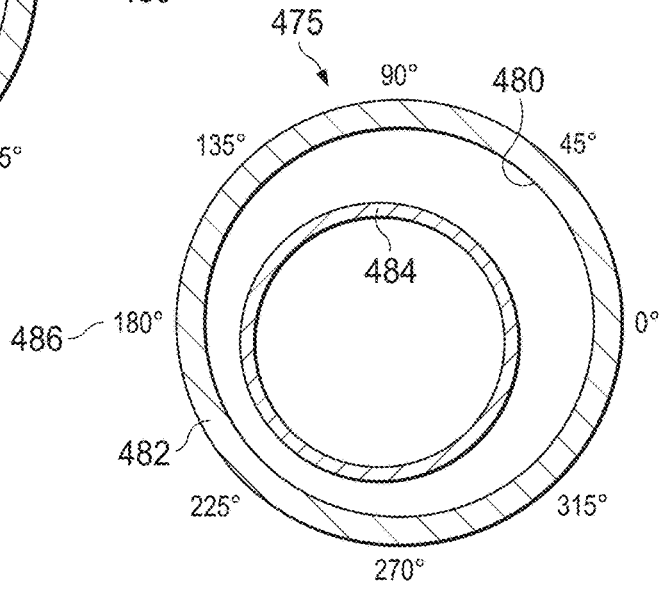
FIG. 4D is an illustration of a diagram of an example view demonstrating a 225° tubing eccentricity.

FIG. 4D is an illustration of a diagram of an example view demonstrating a 225° tubing eccentricity 475. 225° tubing eccentricity 475 demonstrates a cross sectional view of a borehole 480 with a casing 482 (outer black circle). Inserted in borehole 480 is a tubing 484 (inner black circle). Azimuthal angles 486 are arrayed around borehole 480, where the 0° mark is determined by the system or is user determined. Tubing 484 has a magnitude of tubing eccentricity of approximately 75% of the distance toward casing 482 at a direction of approximately the 225° azimuthal angle.

Figure 5:
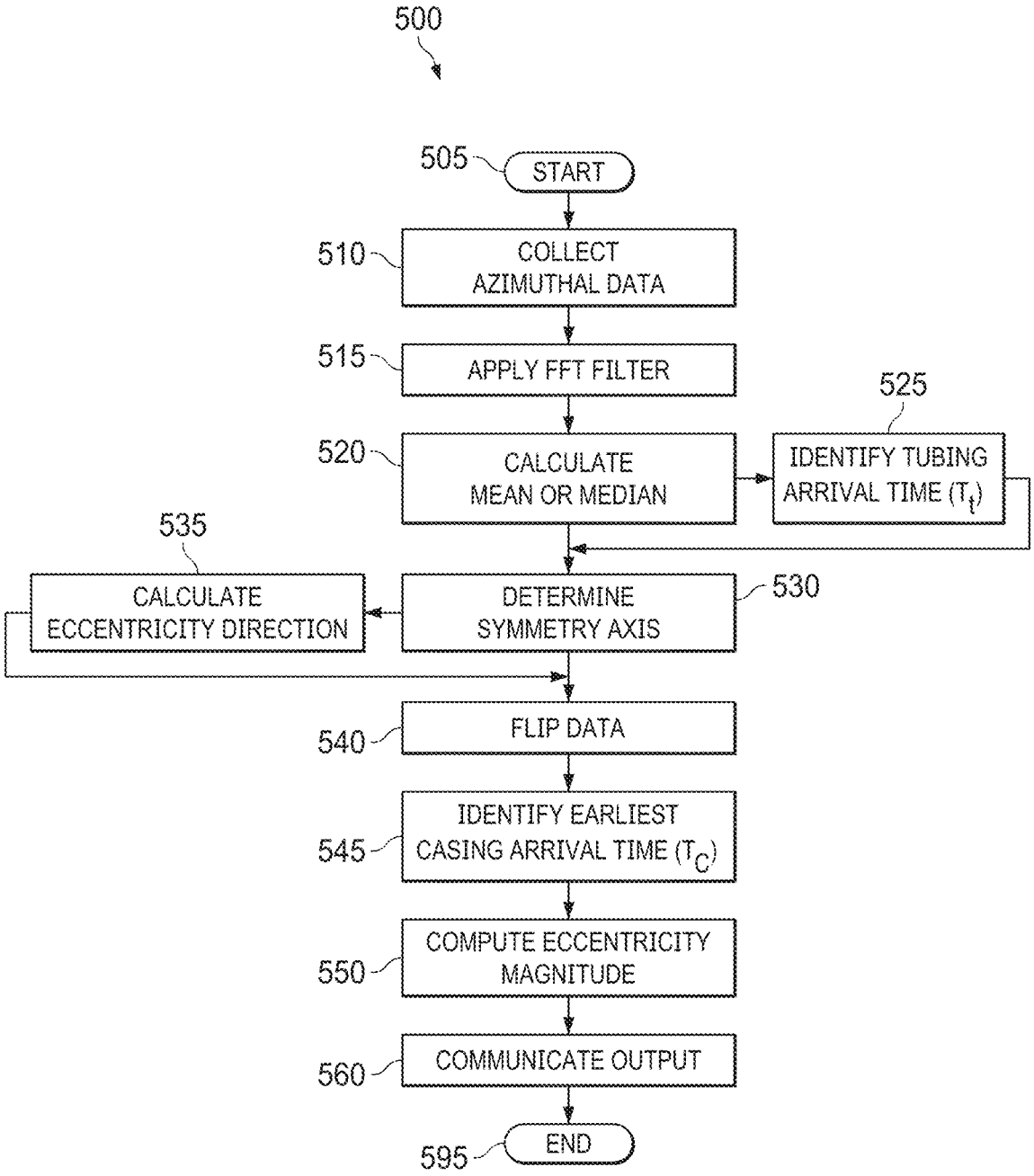
FIG. 5 is an illustration of a flow diagram of an example method to analyze collected acoustic data from a borehole location.

FIG. 5 is an illustration of a flow diagram of an example method 500 to filter, transform, and analyze collected acoustic data from a borehole location. Method 500 can be performed, for example, by users performing analysis operations. Method 500 can be performed on a computing system, for example, acoustic analyzer system 800 of FIG. 8 or acoustic analyzer controller 900 of FIG. 9. The computing system can be a down hole tool, a reservoir controller, a data center, a cloud environment, a server, a laptop, a mobile device, or other computing system capable of receiving the collected data, input parameters, and capable of communicating with other computing systems. Method 500 can be encapsulated in software code or in hardware, for example, an application, code library, dynamic link library, module, function, RAM, ROM, and other software and hardware implementations. The software can be stored in a file, database, or other computing system storage mechanism. Method 500 can be partially implemented in software and partially in hardware.

Method 500 can perform the steps for the described processes, for example, where collected acoustic data related to the azimuth can be passed through a fast Fourier transformation (FFT) filter followed by a mean or median calculation, e.g., calculating a central value. A tubing arrival time ($T_t$) can be calculated. The symmetry axis can be used as a mathematical artifact to determine the direction of the eccentricity as a part of the output and, after inverting the time-series for facilitating the calculation, the earliest casing arrival time ($T_c$) can then be retrieved and compared with $T_t$ to provide the eccentricity magnitude as a part of the output.

More specifically, method 500 starts at a step 505 and proceeds to a step 510. In step 510, a tilted unipole acoustic transmitter can be azimuthally aligned, e.g., using the same angular direction, with an acoustic receiver. The acoustic transmitter and the acoustic receiver can be the acoustic system. In some aspects, an acoustic analyzer, such as acoustic analyzer 820 of FIG. 8 or acoustic analyzer controller 900 of FIG. 9, can be part of the acoustic system.

Figure 6A:
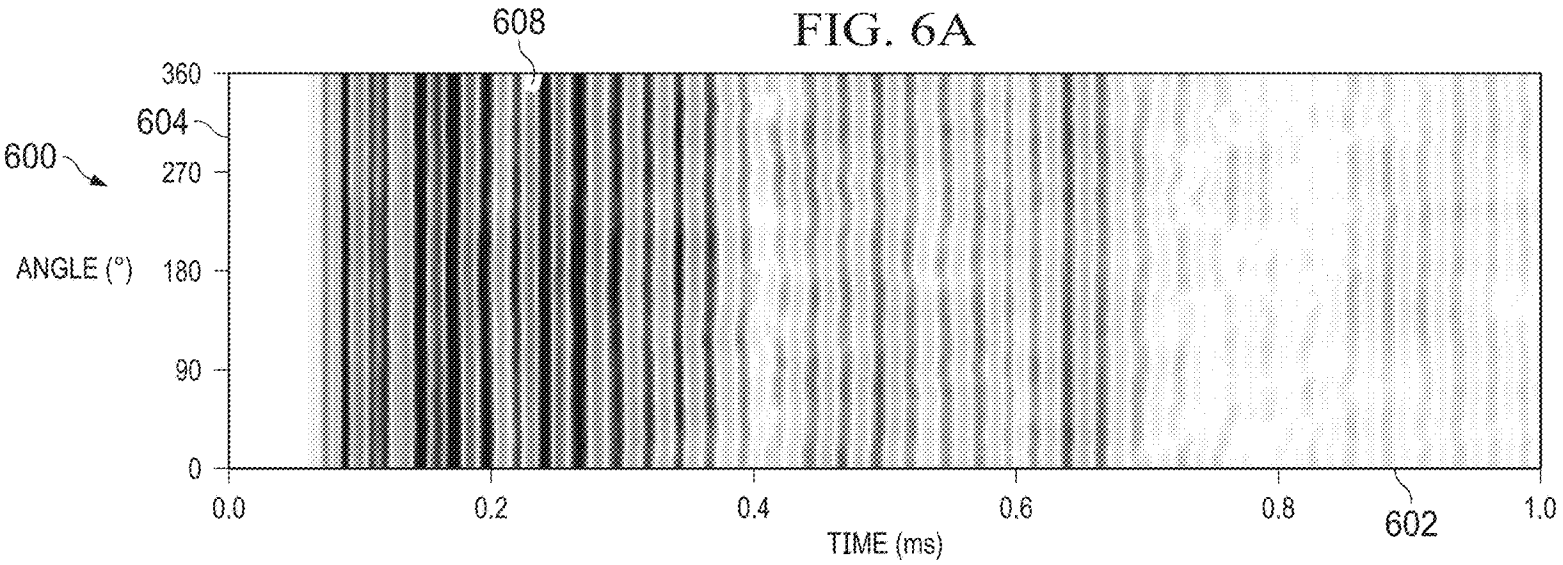
FIG. 6A is an illustration of a diagram of example waveforms of raw acoustic data that has been collected.

The acoustic transmitter and the acoustic receiver can be axially separated by a distance r, with the receiver aligned above or below the transmitter. For each azimuth, e.g., angle, one or more acoustic pulses can be transmitted and the amplitudes of the received signal(s) can be recorded creating the collected data as a time series. This process can be repeated until one revolution of the acoustic system is completed. The angle span of each acoustic pulse can be specified by the operational parameters, for example, 5° or another degree span. A 5° angle span would have 72 data collection points for each revolution of the acoustic system. This procedure can be repeated after axially displacing the acoustic system, such as moving the acoustic system up or down the borehole. A typical raw data series, with amplitudes normalized in the interval [−1, 1], is shown in FIG. 6A.

In a step 515, a band pass FFT filter, or another filter type, can be used utilizing the drive pulse applied to the transmitter. The purpose is to remove high frequency noises and any DC component that may be present in the signal, see, for example, FIG. 6B. For example, when a 50 kilo Hertz (kHz) 1st derivative of the Blackman-Harris Window (BHW) is used, the band pass of the filter can be between 10 kHz and 60 kHz. The exact acceptance band of this filter can be pre-determined by the FFT's frequency characteristics, which were previously defined utilizing their dependency on the original drive pulse.

In a step 520, the median value or mean value, e.g., a central value, of the signal can be calculated using the azimuths. For example, considering an individual sampled waveform, corresponding to a specific azimuth angle z, detected by the receiver. If the waveform is comprised of N amplitude measurement elements $x_{iz}$, one for each equally spaced time interval i, then the time series can be represented by the data set $S_z$ given by $S_z=\{x_{1z}; x_{2z}; \ldots; x_{(i-1)z}; x_{iz}; x_{(i+1)z}; \ldots; x_{(N-1)z}; x_{Nz}\}$.

Looking at a specific sample taken at a particular time i for every azimuth angle, a second set $S_i$ of amplitude measurements can be obtained, where each entry of the ordered set corresponds to an azimuth angle. Therefore, $S_i$ contains the azimuthal information for the same time step i. For example, $S_i=\{x_{i1}; x_{i2}; \ldots ; x_{ik}\}$. By sequentially ordering all the time series $S_z$ corresponding to each individual azimuth angle k, an N×k matrix $S_{N\times k}$ can be obtained. An example of the N×k matrix is shown as Equation 2.

Example $N\times k$ matrix — Equation 2

$$S_{N\times k} = \begin{bmatrix} x_{11} & x_{12} & \cdots & x_{1z} & \cdots & x_{1k} \\ x_{12} & x_{22} & \cdots & x_{2z} & \cdots & x_{2k} \\ \vdots & \vdots & \ddots & \vdots & \ddots & \vdots \\ x_{i1} & x_{i2} & \cdots & x_{iz} & \cdots & x_{ik} \\ \vdots & \vdots & \ddots & \vdots & \ddots & \vdots \\ x_{N1} & x_{N2} & \cdots & x_{Nz} & \cdots & x_{Nk} \end{bmatrix}$$

where the rows represent each sample taken at an specific time step i, and the columns represent each azimuth angle z. The median $\tilde{x}_i$ is obtained by taking the middle value of $S_i$ sets, such as the middle value for each row of the $S_{N\times k}$ matrix. The time series, e.g., the set of each individual median taken for each sample, of the median $\tilde{S}$ is obtained considering the $\tilde{x}_i$ for each i, such as in $\tilde{S}=\{\tilde{x}_1, \tilde{x}_2, \ldots, \tilde{x}_N\}$.

In some aspects, method 500 can proceed to a step 525 to identify tubing arrival times. In some aspects, method 500 can proceed to a step 530 to determine a symmetry of axis. In step 525, the $\tilde{S}$ can be used to identify the time of the tubing arrival $T_t$. A peak detection function can be used to identify the first peak given a threshold $p_t$, see, for example, FIG. 6C.

In some aspects, the median signal $\tilde{S}$ can be subtracted from the raw azimuthal data. This procedure can create the median filtered data matrix $Y_{N\times k}$, such as using the equation $S_{N\times k}-\tilde{S}=Y_{N\times k}$. In an eccentric tubing or casing configuration, if the tool is concentric with the tubing, then the tubing arrivals can be similar for all azimuths. The median filter can remove the similar arrivals subtracting the mean or median signal. This procedure can reveal the casing or borehole inner surface arrival times more clearly. Different tool to casing/borehole inner surface distances can produce different arrival times and those different arrival times can be used to characterize the eccentricity of the tubing, see, for example, FIG. 6D. For example, Equation 3 is a matrix view of the subtraction operation.

Example matrix subtraction operation to determine tubing arrival times. — Equation 3

$$\begin{bmatrix} x_{11} & x_{12} & \cdots & x_{1z} & \cdots & x_{1k} \\ x_{12} & x_{22} & \cdots & x_{2z} & \cdots & x_{2k} \\ \vdots & \vdots & \ddots & \vdots & \ddots & \vdots \\ x_{i1} & x_{i2} & \cdots & x_{iz} & \cdots & x_{ik} \\ \vdots & \vdots & \ddots & \vdots & \ddots & \vdots \\ x_{N1} & x_{N2} & \cdots & x_{Nz} & \cdots & x_{Nk} \end{bmatrix} - \begin{bmatrix} \tilde{x}_1 \\ \tilde{x}_2 \\ \vdots \\ \tilde{x}_i \\ \vdots \\ \tilde{x}_N \end{bmatrix} = \begin{bmatrix} y_{11} & y_{12} & \cdots & y_{1z} & \cdots & y_{1k} \\ y_{12} & y_{22} & \cdots & y_{2z} & \cdots & y_{2k} \\ \vdots & \vdots & \ddots & \vdots & \ddots & \vdots \\ y_{i1} & y_{i2} & \cdots & y_{iz} & \cdots & y_{ik} \\ \vdots & \vdots & \ddots & \vdots & \ddots & \vdots \\ y_{N1} & y_{N2} & \cdots & y_{Nz} & \cdots & y_{Nk} \end{bmatrix}$$

In a step 530, the axis of symmetry can be determined by comparing the time series of both sides at each azimuth z. The root mean square ($RMS_z$) of the difference can be calculated using Equation 4, where the periodic boundary condition of the azimuth positions can be defined by Equations 5.

Example $RMS_z$ calculation — Equation 4

$$RMS_z = \sqrt{\frac{1}{N(k-1)}\sum_{j=1}^{k-1}\sum_{i=1}^{N}(y_{if(j)} - y_{if(-j)})^2}$$

Example boundary condition calculations — Equations 5

$$f(j) = \begin{cases} z+j, & \text{if } j \le k-z \\ z+j-k, & \text{if } j > k-z \end{cases}$$

$$f(-j) = \begin{cases} z-j, & \text{if } j \le z-1 \\ z-j+k, & \text{if } j > z-1 \end{cases}$$

For example, for the 0° azimuth, the 355° series is subtracted by the 5° series, the 350° series is subtracted by the 10° series, so on. The $RMS_0$ can be calculated taking those differences into account. The process is repeated for each z and the symmetry axis (z*) is given by the azimuth with the minimum value of $RMS_z$, for example, using $z^*=z|RMS_z^*=\min(RMS_z)$.

In some aspects, method 500 can proceed to a step 535 to calculate the direction of eccentricity. In some aspects, method 500 can proceed to a step 540. In some aspects, method 500 can proceed directly to a step 545. In step 535, the direction of eccentricity can be determined by using the symmetry of axis.

In step 540, the series can be flipped to eliminate some undesirable noises in the collected data, to generate flipped acoustic data. This process is possible because the axis of symmetry is known. Equation 6 is an example algorithm for flipping the data series.

Example flipping algorithm — Equation 6

$$S_z^* = \frac{S_{z-1} + S_{z+1}}{2}$$

where $z\neq z^*$. An example of a flipped series is shown in FIG. 6E.

In step 545, the earliest casing arrival time can be identified from the data from step 530 or step 540. The earliest casing arrival time ($T_c$) can be derived from the periodic pattern that is formed from the data processing. For example, the $T_c$ identification is shown in FIG. 6F.

In a step 550, an estimate of the eccentricity can be computed. In some aspects, this computation can utilize the $T_c$ and $T_t$ values previously determined. In some aspects, the eccentricity can be computed using the third interface echo (TIE) acoustic paths. Equation 7 is an example of relating the magnitude of the eccentricity with the geometries of the system and the acoustic arrival times.

Example estimation of the magnitude of the eccentricity of tubing — Equation 7

$$ecc = \frac{c_{id} - \text{tool}_{od} + \sqrt{p^2(t_{id} - \text{tool}_{od})^2 + r^2(p^2-1)}}{c_{id} - t_{od}}$$

where $$p \text{ is } \frac{T_c}{T_t},$$

$T_c$ is the earliest casing arrival time, $T_t$ is the tubing arrival time, r is the distance of the transmitter-receiver offset, $c_{id}$ is the casing or subterranean formation inner diameter, $t_{od}$ is the tubing outer diameter, $t_{id}$ is the tubing inner diameter, and $tool_{od}$ is the tool outer diameter.

In a step 560, the results can be output and communicated. In some aspects, the results can be transformed to a data format usable by the user or another computing system. The results can include the input file data with the raw acoustic data or partially transformed acoustic data, and other interim outputs. The results can be utilized by other analysis systems to further determine preventative or corrective actions. Method 500 ends at a step 595.

FIG. 6A is an illustration of a diagram of example waveforms 600 of raw acoustic data that has been collected. Waveforms 600 shows a demonstration of normalized raw data obtained after one revolution of the acoustic analyzer system. For this demonstration an r of 4 inches, a drive pulse of 50 kHz, and a tilting angle of 25° was used. Waveforms 600 has an x-axis 602 showing the time in milliseconds (ms) of the collected data, e.g., forming the raw data time series. A y-axis 604 shows the azimuthal angle, in degrees, of the collected data. Plot area 608 shows the collected raw data, e.g., the collected time series data. The shading color of plot area 608 shows the relative varying intensity of the amplitude of the collected time series data.

Figure 6B:
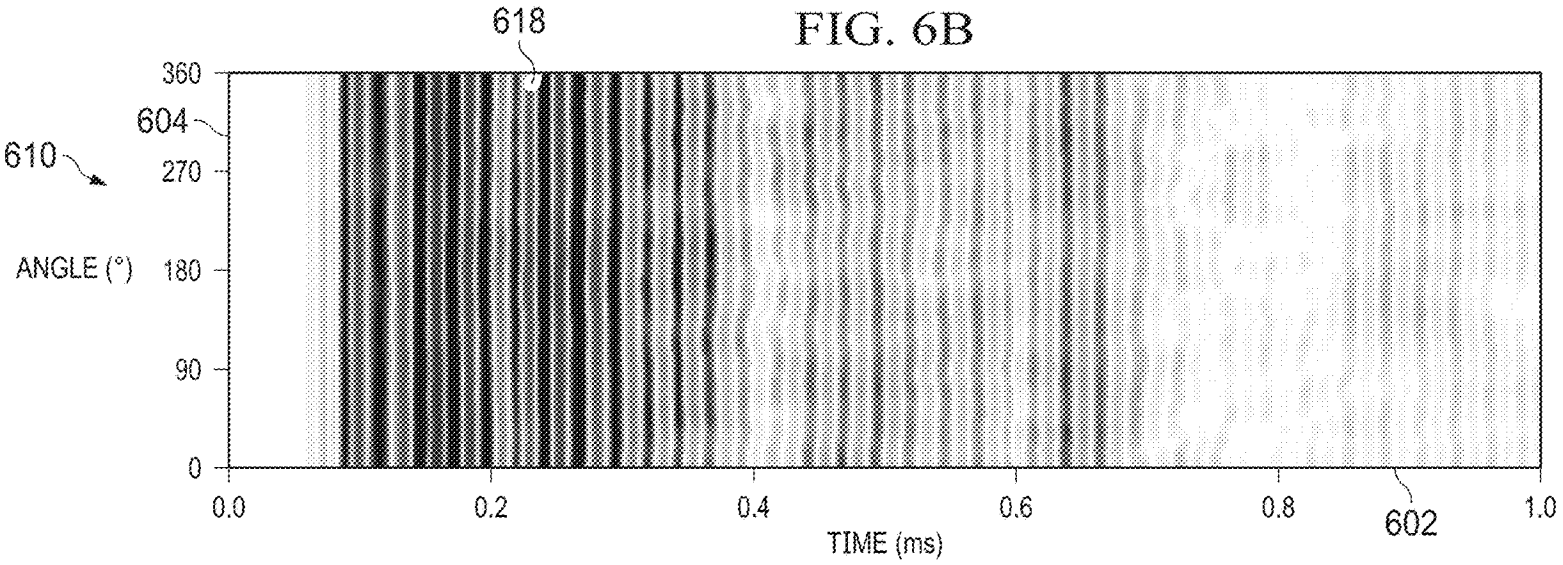
FIG. 6B is an illustration of a diagram of example waveforms after a fast Fourier transform (FFT) filter has been applied.

FIG. 6B is an illustration of a diagram of example waveforms 610 after a FFT filter has been applied. Waveforms 610, for this demonstration, has a FFT filter applied at 10 kHz and 60 kHz. X-axis 602 and y-axis 604 are the same as shown in FIG. 6A. Plot area 618 shows the FFT filter transformed data. The shading color of plot area 618 shows the relative varying intensity of the amplitude of the collected time series data.

Figure 6C:
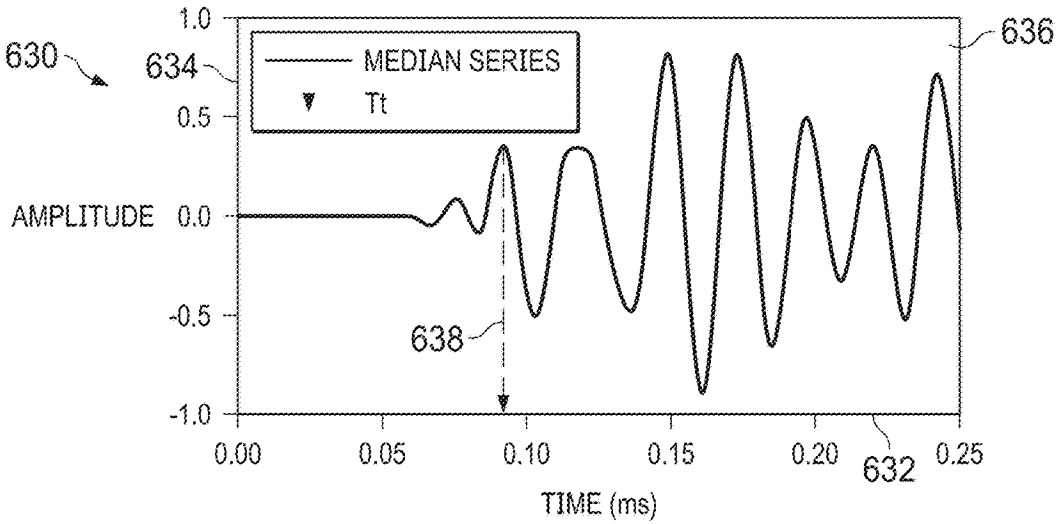
FIG. 6C is an illustration of a diagram of example waveform identifying the tubing arrival time.

FIG. 6C is an illustration of a diagram of example waveforms 630 identifying the tubing arrival time ($T_t$). Median series $\tilde{S}$ can be obtained by extracting the values given by the median or mean filtering of the data. Waveforms 630 has an x-axis 632 showing the collected data over time in ms. A y-axis 634 shows the relative amplitude of the data. Plot area 636 shows the median filtered data series as the solid line. Dashed line 638 indicates the time of the first tubing arrival $T_t$.

Figure 6D:
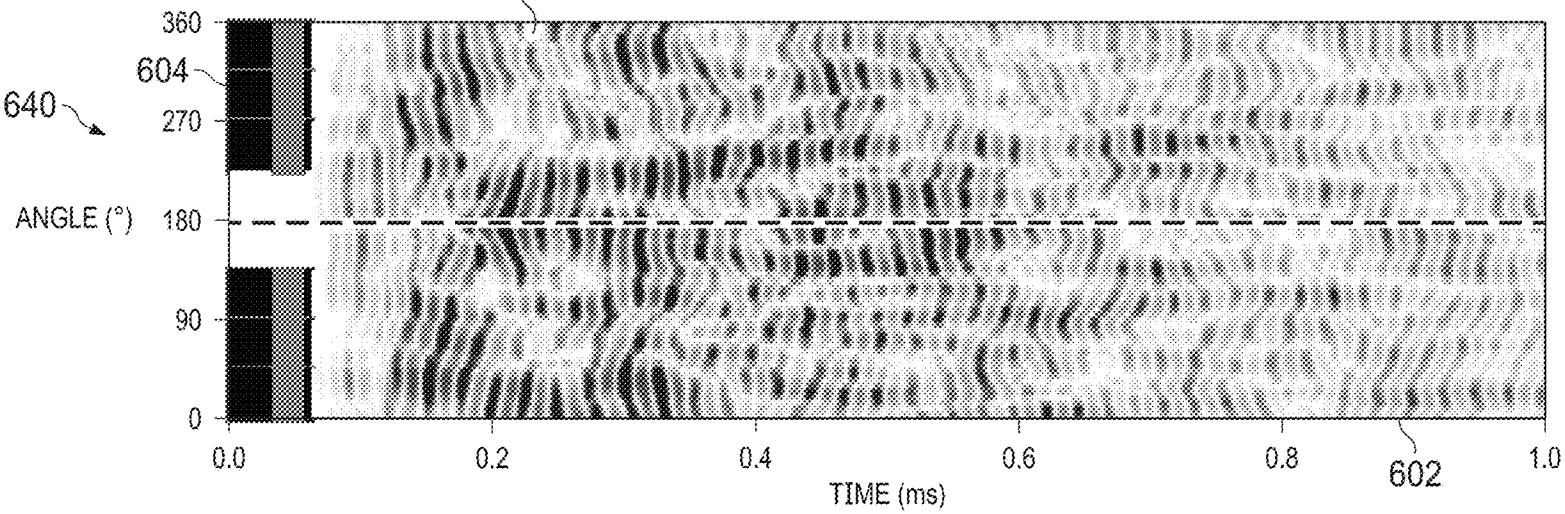
FIG. 6D is an illustration of a diagram of example waveforms applying a median or mean filter.
Figure 6E:
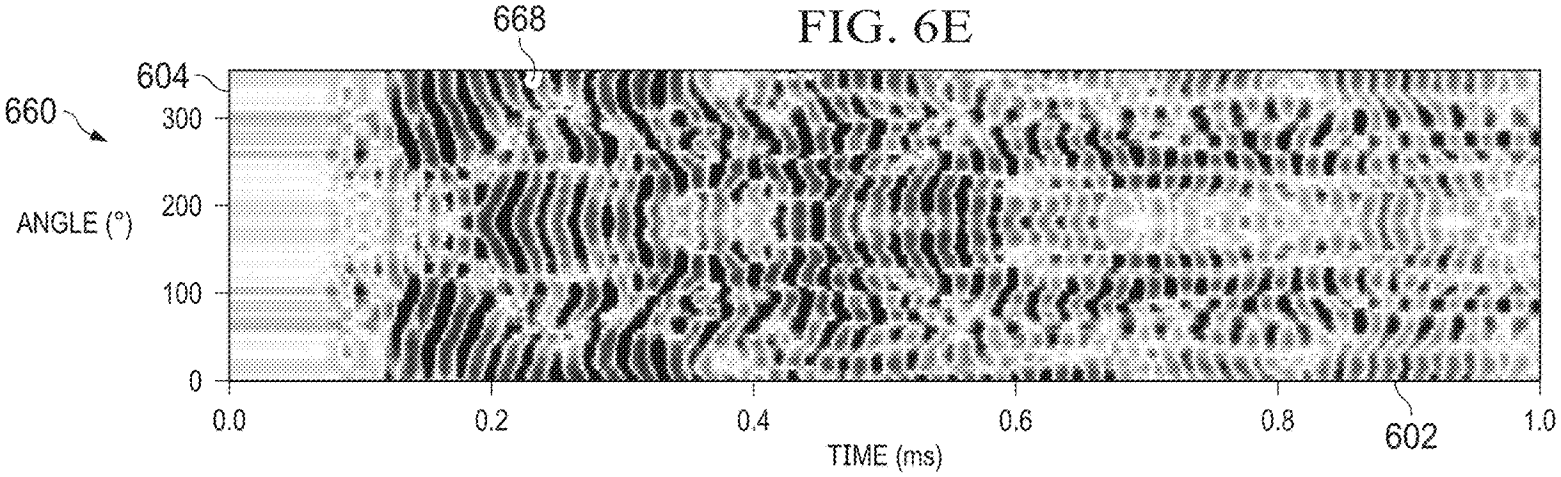
FIG. 6E is an illustration of a diagram of example waveforms flipping the data around the axis of symmetry.
Figure 6F:
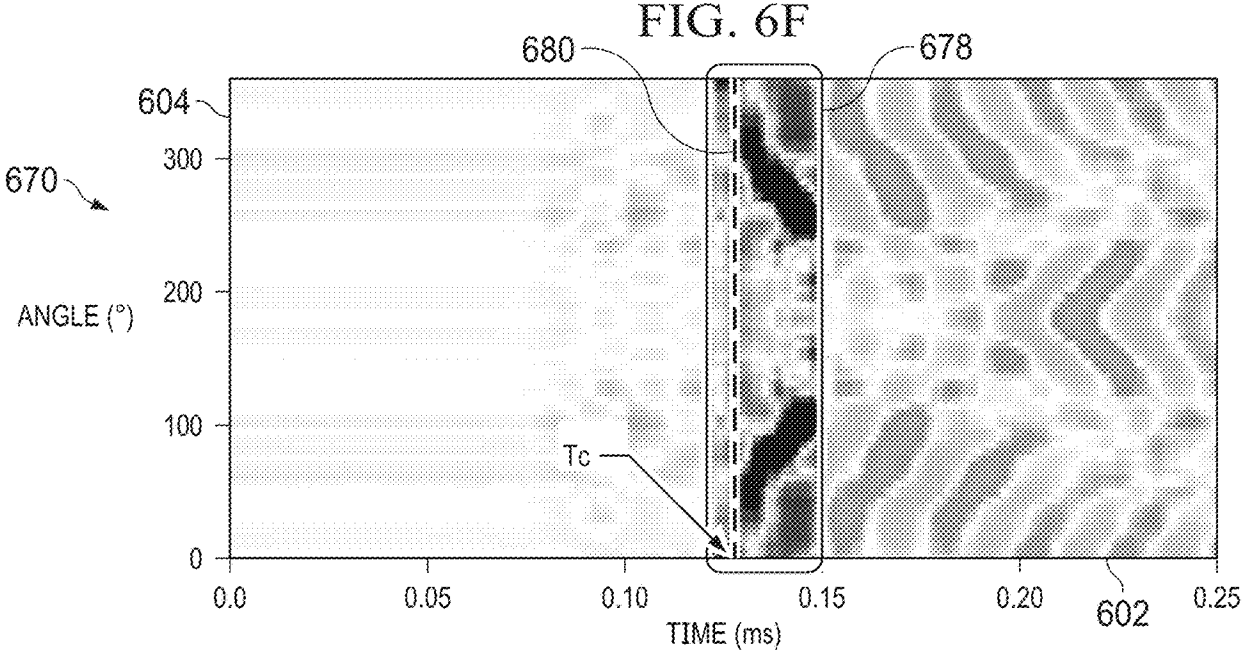
FIG. 6F is an illustration of a diagram of example waveforms identifying the earliest casing arrival time.

FIG. 6D is an illustration of a diagram of example waveforms 640 applying a median or mean filter. X-axis 602 and y-axis 604 are the same as shown in FIG. 6A. Plot area 648 shows the data series after applying the median or mean filter to the FFT filter processed data. The shading color of plot area 648 shows the relative varying intensity of the amplitude of the collected time series data.

FIG. 6E is an illustration of a diagram of example waveforms 660 flipping the data around the axis of symmetry. X-axis 602 and y-axis 604 are the same as shown in FIG. 6A. Plot area 668 shows the data series after flipping the series around the axis of symmetry z*. The shading color of plot area 668 shows the relative varying intensity of the amplitude of the collected time series data.

FIG. 6F is an illustration of a diagram of example waveforms 670 identifying the earliest casing arrival time ($T_c$). X-axis 602 and y-axis 604 are the same as shown in FIG. 6A. Waveforms 670 shows a partial view of the data collected to emphasize the data pattern that can be determined or observed. Box 678 shows the periodic pattern that is formed after applying the one or more various transformations and filters. Dashed line 680 shows the earliest casing arrival time ($T_c$). The shading color of the waveforms within box 678 shows the relative varying intensity of the amplitude of the collected time series data.

Figure 7:
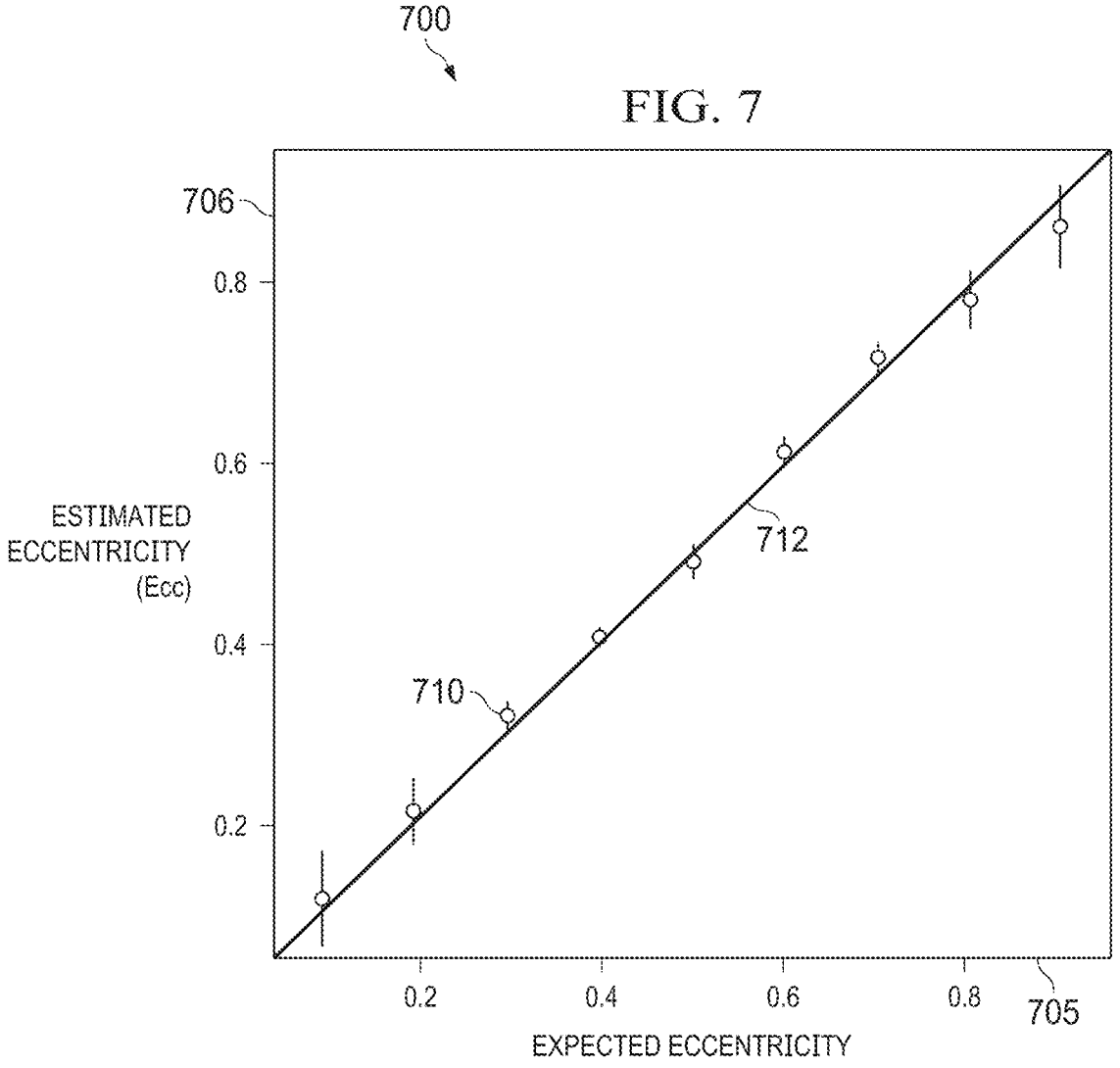
FIG. 7 is an illustration of a diagram of an example plot showing sample acoustic data.

FIG. 7 is an illustration of a diagram of an example plot 700 showing sample acoustic data. Varying eccentricities from 10% to 90% were used as sample data for plot 700 and were compared to nominal values, e.g., expected values. An x-axis 705 shows the expected eccentricity using the sample data. A y-axis 706 shows the estimated eccentricity using the described processes. Line 712 shows the nominal values, where the estimated values match the expected values. Plot points 710 show the estimated eccentricity using the processes described herein. Plot points 710 fall roughly in line with line 712 showing that the described processes can produce results that can be reliably used in other processes and systems. The small vertical bars on each plot points 710 are error bars and reflect the uncertainty in obtaining $T_c$.

Figure 8:
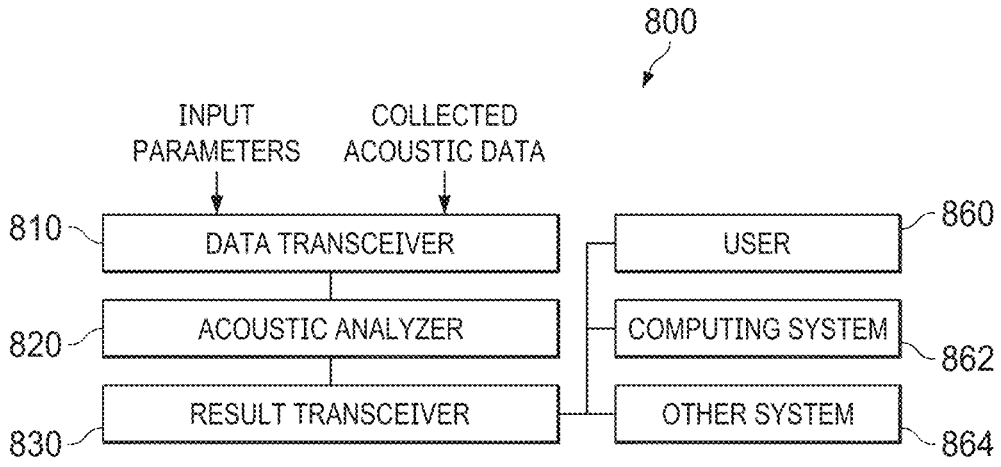
FIG. 8 is an illustration of a block diagram of an example acoustic analyzer system.

FIG. 8 is an illustration of a block diagram of an example acoustic analyzer system 800, which can be implemented in one or more computing systems, for example, a downhole tool, a data center, cloud environment, server, laptop, smartphone, tablet, and other computing systems. In some aspects, acoustic analyzer system 800 can be implemented using an acoustic analyzer controller such as acoustic analyzer controller 900 of FIG. 9. Acoustic analyzer system 800 can implement one or more methods of this disclosure, such as method 500 of FIG. 5.

Acoustic analyzer system 800, or a portion thereof, can be implemented as an application, a code library, dynamic link library, function, module, other software implementation, or combinations thereof. In some aspects, acoustic analyzer system 800 can be implemented in hardware, such as a ROM, a graphics processing unit, or other hardware implementation. In some aspects, acoustic analyzer system 800 can be implemented partially as a software application and partially as a hardware implementation. Acoustic analyzer system 800 is a functional view of the disclosed processes and an implementation can combine or separate the described functions in one or more software or hardware systems.

Acoustic analyzer system 800 includes a data transceiver 810, an acoustic analyzer 820, and a result transceiver 830. The generated results and interim outputs from acoustic analyzer 820 can be communicated to a data receiver, such as one or more of a user or user system 860, a computing system 862, or other processing or storage systems 864. The generated results can be used to determine whether and when corrective action should be implemented, or the type of correction action. For example, planning on replacing a section of casing due to potential excess wear.

Data transceiver 810 can receive input parameters, such as parameters to direct the operation of the analysis implemented by acoustic analyzer 820. For example, the type of filtering and transformations to apply, e.g., filtering algorithms and transformation algorithms, whether a mean or median filtering is applied (to generate a mean value or median value, e.g., a central value), and other input parameters. In some aspects, data transceiver 810 can be part of acoustic analyzer 820.

Result transceiver 830 can communicate one or more generated results, interim outputs, or data from the collected acoustic data, to one or more data receivers, such as user or user system 860, computing system 862, storage system 864, e.g., a data store or database, or other related systems. Data transceiver 810, acoustic analyzer 820, and result transceiver 830 can be, or can include, conventional interfaces configured for transmitting and receiving data.

Acoustic analyzer 820 can implement the analysis and algorithms as described herein utilizing the collected acoustic data and the input parameters. For example, acoustic analyzer 820 can perform the various filtering, transformations, and analysis as described herein. A memory or data storage of acoustic analyzer 820 can be configured to store the processes and algorithms for directing the operation of acoustic analyzer 820. Acoustic analyzer 820 can also include a processor that is configured to operate according to the analysis operations and algorithms disclosed herein, and an interface to communicate (transmit and receive) data.

Figure 9:
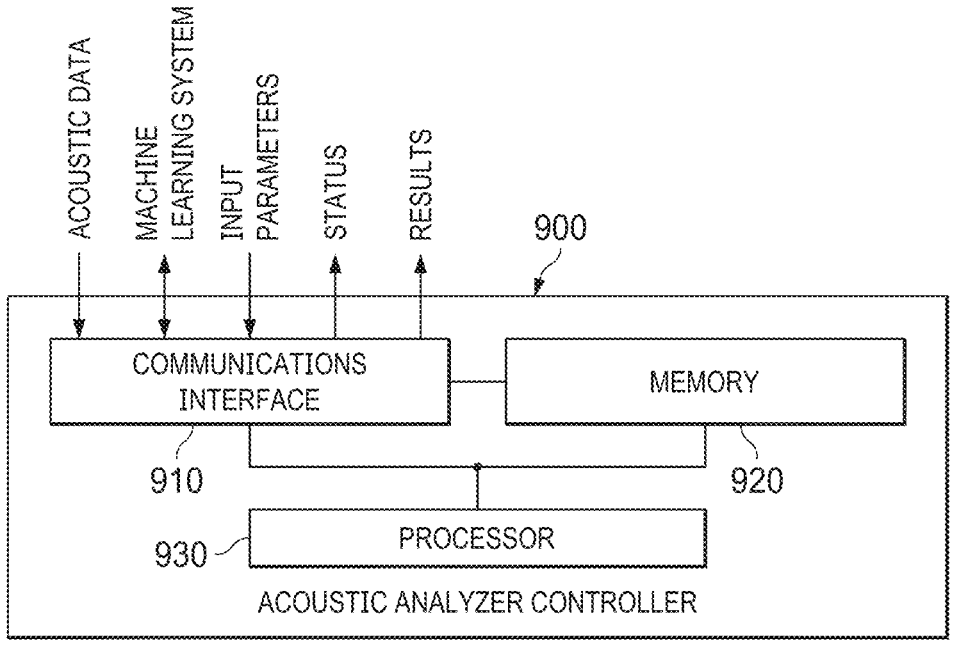
FIG. 9 is an illustration of a block diagram of an example of an acoustic analyzer controller according to the principles of the disclosure.

FIG. 9 is an illustration of a block diagram of an example of acoustic analyzer controller 900 according to the principles of the disclosure. Acoustic analyzer controller 900 can be stored on a single computer or on multiple computers. The various components of acoustic analyzer controller 900 can communicate via wireless or wired conventional connections. A portion or a whole of acoustic analyzer controller 900 can be located at one or more locations and other portions of acoustic analyzer controller 900 can be located on a computing device or devices located downhole or at a surface location. In some aspects, acoustic analyzer controller 900 can be wholly located at a surface or distant location. In some aspects, acoustic analyzer controller 900 can be part of another system, and can be integrated in a single device, such as a part of down hole tools.

Acoustic analyzer controller 900 can be configured to perform the various functions disclosed herein including receiving input parameters and collected acoustic data, and generating results from an execution of the methods and processes described herein. Acoustic analyzer controller 900 includes a communications interface 910, a memory 920, and a processor 930.

Communications interface 910 is configured to transmit and receive data. For example, communications interface 910 can receive the input parameters and the collected acoustic data. Communications interface 910 can transmit the generated results, data from the input files, the collected acoustic data, or interim outputs. In some aspects, communications interface 910 can transmit a status, such as a success or failure indicator of acoustic analyzer controller 900 regarding receiving the various inputs, transmitting the generated results, or producing the generated results.

In some aspects, communications interface 910 can receive input parameters from a machine learning system, such as when the collected acoustic data is processed through a machine learning algorithm prior to the described processing steps, for example, to improve the collected data by removing excess noise from the signals. In some aspects, a machine learning system can generate risks and mitigation operations, where the machine learning system uses the eccentricity direction, the eccentricity magnitude, and the borehole location as inputs, and the risks and mitigation operations are communicated to another system or process.

In some aspects, the machine learning system can be implemented by processor 930 and perform the operations as described by acoustic analyzer 820 of FIG. 8. Communications interface 910 can communicate via communication systems used in the industry. For example, wireless or wired protocols can be used. Communication interface 910 is capable of performing the operations as described for data transceiver 810 and result transceiver 830 of FIG. 8.

Memory 920 can be configured to store a series of operating instructions that direct the operation of processor 930 when initiated, including the code representing the algorithms for determining processing the collected data. Memory 920 is a non-transitory computer readable medium. Multiple types of memory can be used for data storage and memory 920 can be distributed.

Processor 930 can be configured to produce the generated results, one or more interim outputs, and statuses utilizing the received inputs. For example, processor 930 can apply one or more filters, perform one or more transformations, and perform an analysis of the data. Processor 930 can be configured to direct the operation of the acoustic analyzer controller 900. Processor 930 includes the logic to communicate with communications interface 910 and memory 920, and perform the functions described herein. Processor 930 is capable of performing or directing the operations as described by acoustic analyzer 820 of FIG. 8.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of the aspects disclosed in the SUMMARY section can have one or more of the following additional elements in combination. Element 1: further including communicating results to one or more borehole operation systems, wherein the results include the eccentricity direction and the eccentricity magnitude. Element 2: wherein the calculating the eccentricity direction further utilizes the tubing arrival time or a third interface echo (TIE) acoustic path. Element 3: wherein the central value is a mean value or a median value. Element 4: further including flipping the transformed acoustic data after the calculating the eccentricity direction and prior to the identifying the earliest casing arrival time to generate a flipped acoustic data. Element 5: wherein the identifying utilizes the flipped acoustic data as the transformed acoustic data. Element 6: wherein the acoustic system is tilted at a specified angle relative to the tubing or a wireline within the borehole. Element 7: wherein the input parameters are one or more of a tubing diameter, a tubing thickness, a casing diameter, a casing thickness, a characteristic of a subterranean formation, a type of transformations to apply, a filtering algorithm, or a distance between a transmitter of the acoustic system and a receiver of the acoustic system. Element 8: wherein prior to the applying the FFT filter, the acoustic data is processed using a machine learning system. Element 9: further including an acoustic system, capable of collecting the acoustic data and communicating the acoustic data to the data transceiver. Element 10: wherein the acoustic system has at least one acoustic transmitter and at least one acoustic receiver separated by specified distance, and the acoustic system is located downhole of the borehole. Element 11: wherein the acoustic system includes the data transceiver and the acoustic analyzer. Element 12: wherein the acoustic system is part of downhole tools. Element 13: wherein the acoustic analyzer and the data transceiver are part of a well site controller or a computing system. Element 14: further including a result transceiver, capable of communicating results, interim outputs, and the collected acoustic data to a user system, a data store, or a computing system, wherein the results include the eccentricity magnitude and the eccentricity direction. Element 15: wherein prior to the applying the FFT filter, the acoustic data is processed using a machine learning system. Element 16: further including utilizing a machine learning system to generate risks and mitigation operations. Element 17: wherein the machine learning system uses the eccentricity direction, the eccentricity magnitude, and the borehole location as inputs, and the risks and the mitigation operations are communicated to another borehole operation system or borehole operation process.

What is claimed is:

1. A method to determine eccentricity of a tubing within a borehole, comprising:

collecting acoustic data from an acoustic system located within the borehole, wherein the acoustic data is collected at more than one azimuthal position at a borehole location;

generating transformed acoustic data by applying a fast Fourier transformation (FFT) filter to the acoustic data;

calculating a central value of the transformed acoustic data;

identifying a tubing arrival time using the central value and the transformed acoustic data, wherein the tubing arrival time relates to the acoustic data and the tubing;

determining a symmetry of axis for the transformed acoustic data;

calculating an eccentricity direction of the tubing using the symmetry of axis, and the transformed acoustic data;

identifying an earliest casing arrival time utilizing the transformed acoustic data;

computing an eccentricity magnitude of the tubing utilizing the transformed acoustic data, received input parameters, the tubing arrival time, and the earliest casing arrival time, using the acoustic analyzer; and performing a corrective action on the tubing based on the eccentricity magnitude, wherein the corrective action includes replacing a section of the tubing or adjusting a position of the tubing in order to improve cement evaluation, or prevent or reduce wear on the tubing or casing within the borehole.

2. The method as recited in claim 1, further comprising:

communicating results to one or more borehole operation systems, wherein the results include the eccentricity direction and the eccentricity magnitude.

3. The method as recited in claim 1, wherein the calculating the eccentricity direction further utilizes the tubing arrival time or a third interface echo (TIE) acoustic path.

4. The method as recited in claim 1, wherein the central value is a mean value or a median value.

5. The method as recited in claim 1, further comprising:

flipping the transformed acoustic data after the calculating the eccentricity direction and prior to the identifying the earliest casing arrival time to generate a flipped acoustic data, and wherein the identifying utilizes the flipped acoustic data as the transformed acoustic data.

6. The method as recited in claim 1, wherein the acoustic system is tilted at a specified angle relative to the tubing or a wireline within the borehole.

7. The method as recited in claim 1, wherein the input parameters are one or more of a tubing diameter, a tubing thickness, a casing diameter, a casing thickness, a characteristic of a subterranean formation, a type of transformations to apply, a filtering algorithm, or a distance between a transmitter of the acoustic system and a receiver of the acoustic system.

8. The method as recited in claim 1, further comprising removing, prior to the applying the FFT filter, noise from the acoustic data using a machine learning algorithm.

9. A system, comprising:

a data transceiver, capable of receiving input parameters and collected acoustic data, wherein the acoustic data is collected downhole within a borehole at one or more locations along the borehole, wherein the borehole includes tubing located therein; and an acoustic analyzer, capable of communicating with the data transceiver, applying one or more transformation algorithms to the acoustic data, generating transformed acoustic data by applying one or more filtering algorithms to the acoustic data, wherein the one or more filtering algorithms include a fast Fourier transformation (FFT) filter algorithm, calculating a central value of the transformed acoustic data, identifying a tubing arrival time using the central value, determining a symmetry of axis of the transformed acoustic data, calculating an eccentricity direction of the tubing using the symmetry of axis, identifying an earliest casing arrival time, computing an eccentricity magnitude of the tubing utilizing the transformed acoustic data, the tubing arrival time, and the earliest casing arrival time, and initiating, based on the eccentricity magnitude, replacement of a section of the tubing or adjustment of a position of the tubing in order to improve cement evaluation, or prevent or reduce wear on the tubing or casing within the borehole.

10. The system as recited in claim 9, further comprising:

an acoustic system, capable of collecting the acoustic data and communicating the acoustic data to the data transceiver, wherein the acoustic system has at least one acoustic transmitter and at least one acoustic receiver separated by specified distance, and the acoustic system is located downhole of the borehole.

11. The system as recited in claim 10, wherein the acoustic system includes the data transceiver and the acoustic analyzer.

12. The system as recited in claim 10, wherein the acoustic system is part of downhole tools.

13. The system as recited in claim 9, wherein the acoustic analyzer and the data transceiver are part of a well site controller or a computing system.

14. The system as recited in claim 9, further comprising:

a result transceiver, capable of communicating results, interim outputs, and the collected acoustic data to a user system, a data store, or a computing system, wherein the results include the eccentricity magnitude and the eccentricity direction.

15. The system as recited in claim 9, wherein the input parameters are one or more of a tubing diameter, a tubing thickness, a casing diameter, a casing thickness, a characteristic of a subterranean formation, a type of transformations to apply, a type of filtering to apply, or a distance between a transmitter of an acoustic system and a receiver of the acoustic system.

16. A computer program product having a series of operating instructions stored on a non-transitory computer-readable medium that directs a data processing apparatus when executed thereby to perform operations to determine eccentricity of a tubing within a borehole, the operations comprising:

collecting acoustic data from an acoustic system located within the borehole, wherein the acoustic data is collected at more than one azimuthal position at a borehole location;

generating transformed acoustic data by applying a fast Fourier transformation (FFT) filter to the acoustic data;

calculating a central value of the transformed acoustic data;

identifying a tubing arrival time using the central value and the transformed acoustic data, wherein the tubing arrival time relates to the acoustic data and the tubing;

determining a symmetry of axis for the transformed acoustic data;

calculating an eccentricity direction of the tubing using the symmetry of axis, and the transformed acoustic data;

identifying an earliest casing arrival time utilizing the transformed acoustic data;

computing an eccentricity magnitude of the tubing utilizing the transformed acoustic data, received input parameters, the tubing arrival time, and the earliest casing arrival time, using the acoustic analyzer; and performing a corrective action on the tubing based on the eccentricity magnitude, wherein the corrective action includes replacing a section of the tubing or adjusting a position of the tubing in order to improve cement evaluation, or prevent or reduce wear on the tubing or casing within the borehole.

17. The computer program product as recited in claim 16, wherein the operations further comprise:

communicating results to one or more borehole operation systems, wherein the results include the eccentricity direction and the eccentricity magnitude.

18. The computer program product as recited in claim 16, wherein the calculating the eccentricity direction further utilizes the tubing arrival time or a third interface echo (TIE) acoustic path.

19. The computer program product as recited in claim 16, wherein the central value is a mean value or a median value.

20. The computer program product as recited in claim 16, wherein the operations further comprise:

flipping the transformed acoustic data after the calculating the eccentricity direction and prior to the identifying the earliest casing arrival time to generate a flipped acoustic data, and wherein the identifying utilizes the flipped acoustic data as the transformed acoustic data.

21. The computer program product as recited in claim 16, wherein the input parameters are one or more of a tubing diameter, a tubing thickness, a casing diameter, a casing thickness, a characteristic of a subterranean formation, a type of transformations to apply, a filtering algorithm, or a distance between a transmitter of the acoustic system and a receiver of the acoustic system.

22. The computer program product as recited in claim 16, wherein the operations further comprise, prior to the applying of the FFT filter, removing noise from the acoustic data using a machine learning system.

23. The computer program product as recited in claim 16, further comprising: utilizing a machine learning system to generate risks and mitigation operations, wherein the machine learning system uses the eccentricity direction, the eccentricity magnitude, and the borehole location as inputs, and the risks and the mitigation operations are communicated to another borehole operation system or borehole operation process.

* * * * *